US005375301A

United States Patent [19]

Schindler

[11] Patent Number: 5,375,301

[45] Date of Patent: Dec. 27, 1994

[54] TIE CLIP

[76] Inventor: Gabriel Schindler, 14110 Britoak La., Houston, Tex. 77079-3203

[21] Appl. No.: 45,648

[22] Filed: Apr. 9, 1993

[51] Int. Cl.[5] ..... A41D 25/04

[52] U.S. Cl. ..... 24/49 CC; 24/49 S; 24/49 P

[58] Field of Search ..... 24/49 CC, 49 S, 49 P, 24/49 C, 49 TS, 49 R, 331, 332, 338

[56] References Cited

U.S. PATENT DOCUMENTS

| | | | |
|---|---|---|---|
| 635,747 | 10/1899 | Collins | 24/331 |
| 2,671,900 | 3/1954 | Schreter | 24/49 TS X |
| 2,990,551 | 7/1961 | Schreter et al. | 24/49 TS X |
| 3,374,508 | 3/1968 | Slimovitz | 24/49 CC |
| 3,474,503 | 10/1969 | Less . | |
| 4,827,576 | 5/1989 | Prince | 24/49 TS X |
| 5,062,185 | 11/1991 | Howard | 24/49 CC |
| 5,109,547 | 5/1992 | Abdallah | 24/49 S X |
| 5,245,708 | 9/1993 | Campelia et al. | 24/49 C |

*Primary Examiner*—Richard E. Gluck
*Attorney, Agent, or Firm*—Harrison & Egbert

[57] ABSTRACT

A tie clip having a first bar, a second bar extending transversely to the first bar and slidably connected thereto, a first clip affixed to a surface of the first bar, and a second clip affixed to a surface of the second bar. The second bar is slidable along the longitudinal axis of said first bar. The first bar has a longitudinal slot formed therewithin. The second bar has a portion received within the longitudinal slot and slidable within the slot. The first clip has an openable end positioned adjacent an end of the first bar. The second clip has an openable end facing the first bar. The first clip grips the designer label of a tie. The second clip grips a placket of a shirt.

19 Claims, 3 Drawing Sheets

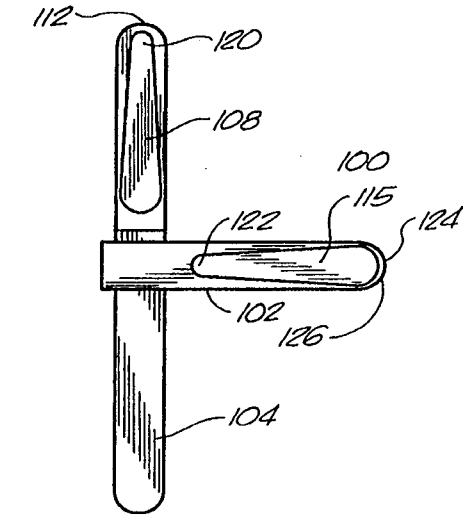
FIG. 6A
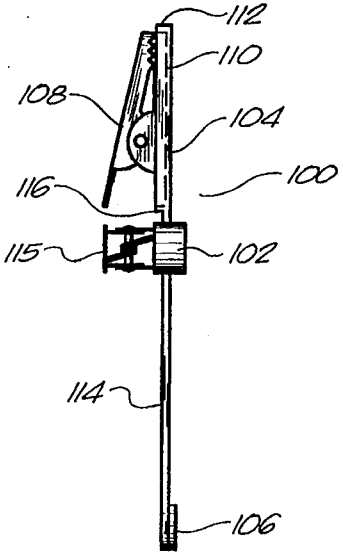
FIG. 6B
FIG. 6C
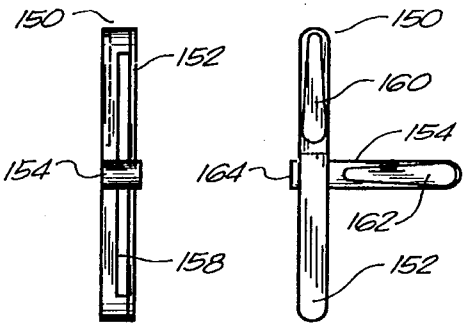
FIG. 8A
FIG. 8B
FIG. 8C
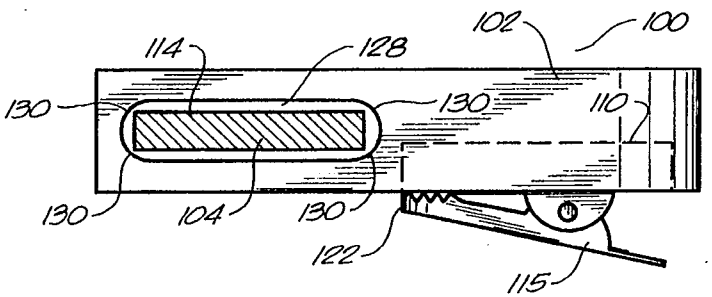
FIG. 7

TIE CLIP

TECHNICAL FIELD

The present invention relates to tie clips, generally. More particularly, the present invention relates to tie clips for joining the designer label of a tie to a shirt.

BACKGROUND OF THE INVENTION

For a great number of years, ties have been used as an important part of business and formal attire. Once tied, the top of the tie is secured within the user's shirtcollar, and the lower ends of the tie lie adjacent the button edge (the placket) of the user's shirt front. In a standard tie, one of the ends is a wide end and this end rests atop the other, narrower end. Since it is desired to maintain the tie in a centered relationship over the placket of the shirt, a number of devices have been developed through the years so as to affix the tie in its proper position.

Unless the ends of the tie are somehow fastened in place, they can move away from the shirt front and thereby cause numerous problems. On a windy day, the ends can be blown about and cause the user to appear disheveled. While eating, if the user leans forward, the tie can swing outwardly and brush against food and become soiled. Without benefit of a restraining device, the tie may generally become misaligned from its optimum position as a result of the wearer's movements.

Several kinds of necktie holders are available which clamp or attach both to the shirt and the necktie and provide a visible and external connection to the tie on the outer appearing surface such as a tie bar or what is commonly known as a "tie tack". The tie bar, of course, clamps both necktie folds to the shirt front. The tie tack, by means of a pin, is attached to the necktie through both folds. A friction clutch engages the pin and is connected by means of a bar and chain to the shirt front through a button hole.

While a tie bar does not mar the outward appearing surface of the tie material, it does have a tendency to skew, slide, and permit the necktie to bulge. A tie tack, even though ornamental and available in a variety of designs, does result in punched holes, broken threads, raveling, and other damage to the tie. This usually requires that the necktie always be worn with a tie tack to avoid showing the damage of the material. Wearer's of neckties would like to avoid the shortcomings of tie bars and tie tacks and would prefer, in many instances, to use no visibly showing holder to maintain the necktie in position because of the natural beauty of the tie material itself.

It has been known to apply a label to the necktie during the manufacturing thereof. This label can serve as a holder for the interior branch of the tie. While this arrangement prevents separation of the two tie branches, it does not position the entire tie relative to the shirt front. In any event, permanent attachments to the necktie are undesirable and complicate the manufacturing process and add to the cost of the necktie. Where a designer label or loop is attached permanently to the tie, it is impractical to provide a buttonhole in such loop or attachment because this requires a tying of the necktie in a precise manner at each wearing. If the necktie is not tied with great care at each wearing, then the loop attachment will not be aligned with one of the shirt buttons.

In the past, various patents have issued on devices for securing the necktie to the shirt. For example, U.S. Pat.

No. 3,474,503, issued on Oct. 28, 1969, to J. W. Less shows a tie anchor connected to the back of the necktie. The tie anchor has a vertically elongated slot therein into which the button of the shirt front of the wearer is inserted. The slot has a vertical height substantially greater than the diameter of the button and a width less than the diameter of the button whereupon the tie can slide up and down on the button during normal movement of the wearer and yet is held adjacent to the shirt front of the wearer. The tie anchor is made of a flexible sheet material. Hook-shaped end portions of the anchor facilitate connecting the anchor to the necktie by slipping the hooked ends through the stitches at the rear of the necktie body.

U.S. Pat. No. 4,219,909, issued on Sep. 2, 1980, to O. V. Anderson shows a combined clasp and tie slide which is designed for use in removably attaching a clasp to a shirt front. The tie slide is adjustable to accommodate neckties of varying widths. This tie slide is adapted so as to hold the necktie in a proper position relative to the front of the shirt.

U.S. Pat. No. 4,827,576, issued on May 9, 1989, to G. W. Prince, Jr. discloses a buttonslot necktie fastener. This fastener is permanently fastened to the back side of a necktie loop/label oriented parallel to the necktie so as to allow the narrow section of the necktie to be captured inbetween the wide section of the necktie and the loop/label. An adhesive material is provided so as to secure to the loop/label. A slot is provided in one section of the fastener so as to be received by a shirt button.

U.S. Pat. No. 5,062,185, issued on Nov. 5, 1991, to R. T. Howard shows a concealable tie clasp which is constructed in a manner such that it attaches to the button hole edge of a shirt and engages the designer label sewn onto the rear surface of the front panel of a four-in-hand necktie. The tie clasp engages the shirt by means of a spring-loaded type of clip. A vertically elongated holding loop is disposed on the forward surface of the clip for engaging the designer label. Once the tie is engaged by the holding loop, the tie remains generally centered above the vertical row of buttons on the shirt, it is permitted limited vertical and horizontal movement.

U.S. Pat. No. 5,109,547, issued on May 5, 1992, to I. A. Abdallah provides an extended neckwear shirt attachment device. This device includes an elongated base member, a button attachment means which is attached in slidable and threaded engagement to the base member so as to form a unitary structure for permitting the slidable movement of the button attachment means along the entire length of the base member. A means is provided so as to fixedly attach the unitary structure to the wide forepart of the extended neckwear. The device is selectively attachable to a button of the shirt of the wearer by engagement of the button attachment means with the button.

It is an object of the present invention to provide a tie clip that is concealed behind the tie during use.

It is another object of the present invention to provide a tie clip which maintains the vertical orientation of the tie during wearing.

It is another object of the present invention to provide a tie clip that allows upward and downward movement of the tie during use.

It is still another object of the present invention to provide a tie clip that is adaptable to a wide variety of tie configurations and shirt configurations.

It is still another object of the present invention to provide a tie clip that is relatively inexpensive and easy to use.

These and other objects and advantages of the present invention will become apparent from a reading of the attached specification and appended claims.

SUMMARY OF THE INVENTION

The concept of the present invention was originally disclosed in Disclosure Document No. 281,727, filed on May 14, 1991 with the United States Patent and Trademark Office.

The present invention is a tie clip that comprises a first bar, a second bar extending transversely to the first bar and slidably connected thereto, a first clip affixed to a surface of the first bar, and a second clip affixed to a surface of the second bar. The second bar is generally shorter than the first bar. The second bar is slidable along a longitudinal axis of the first bar. In a preferred embodiment of the present invention, the first bar has a longitudinal slot formed therewithin. The second bar has a portion received within this longitudinal slot. This portion is slidable within the slot. The second bar has one end extending outwardly from one side of the first bar and another end extending outwardly on an opposite side of the first bar. The portion is positioned between the ends of the second bar. The second bar has a thickness generally equal to a thickness of the first bar. The portion within the slot has a thickness less than a width of the slot.

In another embodiment, the second bar has an interior opening formed therewithin. The first bar extends through this opening. The second bar is slidable along an outer surface of the first bar. The first bar has a stop positioned on an end of the first bar opposite the first clip. The first bar and the stop have a thickness greater than the width of the opening.

The first clip has an openable end which is positioned adjacent an end of the first bar. The second clip has an openable end facing the first bar. The first bar and the second bar have a top surface. The first clip is affixed to the top surface of the first bar. The second clip is affixed to the top surface of the second bar. Each of the first and second clips is an alligator clip. This alligator clip has an openable end and an actuating end. The openable end of the first clip is positioned adjacent an end of the first bar. The actuating end of the second clip is positioned adjacent an end of the second bar opposite the first bar.

The first bar has an indented surface formed adjacent one end of the first bar. The first clip is received within this indented surface. The second bar has an indented surface adjacent an end opposite the first bar. The second clip is received within this indented surface.

The first clip has a flat engagement area. This toothed engagement area serves to affix to the designer label (or loop) of a tie. The second clip includes a similar flat linear toothed engagement area for affixing to a placket of a shirt.

BRIEF DESCRIPTION OF THE DRAWINGS

FIG. 6A is a frontal view of a first alternative embodiment of the present invention.

FIG. 6B is a side view of a first alternative embodiment of the present invention.

FIG. 6C is a rearward view of a first alternative embodiment of the present invention.

FIG. 7 is a top cross-sectional view of the first alternative embodiment of the present invention.

FIG. 8A is a frontal view of a second alternative embodiment of the present invention.

FIG. 8B is a side view of the second alternative embodiment of the present invention.

FIG. 8C is a rearward view of the second alternative embodiment of the present invention.

DETAILED DESCRIPTION OF THE INVENTION

Figure 1:
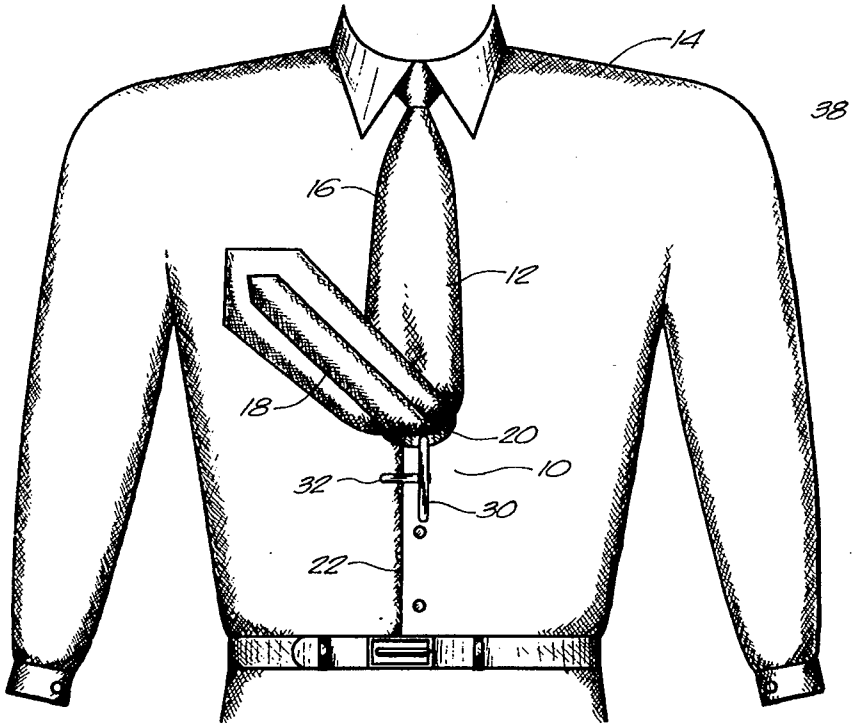
FIG. 1 is a frontal view showing the preferred embodiment of the tie clip of the present invention as attached to the shirt and tie.

Referring to FIG. 1, there is shown at 10 the tie clip in accordance with the preferred embodiment of the present invention. It can be seen that the tie clip 10 is configured so as to secure the tie 12 to the shirt 14 of a wearer. The tie 12 includes a forward portion 16 and a narrow rearward portion 18. As can be seen in FIG. 1, the narrow rearward portion 18 of tie 12 extends through loop 20 on the back surface of the forward portion 16. The loop 20 serves to secure the rearward portion 18 against the back surface of the forward portion 16 of tie 12.

The tie clip 10 is configured so as to secure the loop 20 in a proper position adjacent to the forward portion of the placket 22 of shirt 14. The tie clip 10 includes a first bar 30 and a second bar 32. As used herein, the term "bar" can refer to rigid and flexible solid members. The first bar 30 is positioned vertically in parallel alignment with respect to the placket 22 of shirt 14. The second bar 32 extends transversely and horizontally with respect to the first bar 30. As will be described hereinafter, the first bar 30 is secured to the loop 20 through the use of a first clip. Similarly, the second bar 32 is secured to the placket 22 by means of a second clip.

As can be seen in FIG. 1, the first bar 30 is maintained in slidable relationship relative to the second bar 32. As such, when the wearer 14 straightens his posture or moves upwardly, the first bar 30 will slide upwardly relative to the second bar 32. Alternatively when the wearer bends over, then the first bar 30 will slide downwardly relative to the second bar 32. In all instances, the tie clip 10 of the present invention will cause the tie to be maintained in a proper vertical alignment with respect to the shirt 14. The device of the present invention generally prevents side-to-side or swaying motion of the tie 12. The tie clip 10 of the present invention also prevents the tie 12 from dislodgment from the front of the shirt 14.

Figures 2A, 2B:
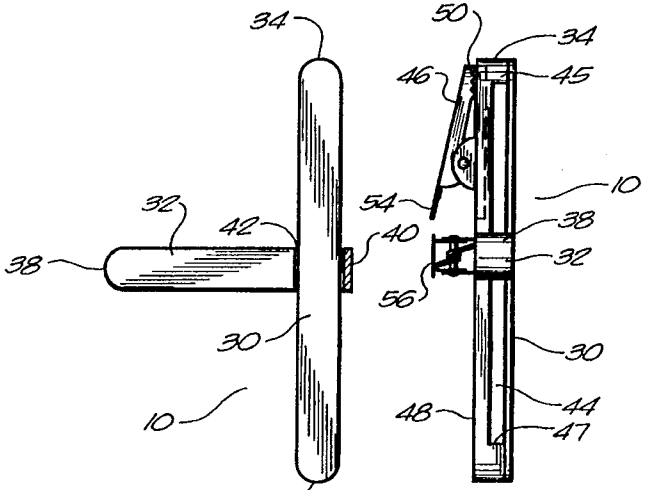
FIG. 2A is a frontal view of the preferred embodiment of the tie clip of the present invention.
FIG. 2B is a side view of the preferred embodiment of the present invention.
Figure 2C:
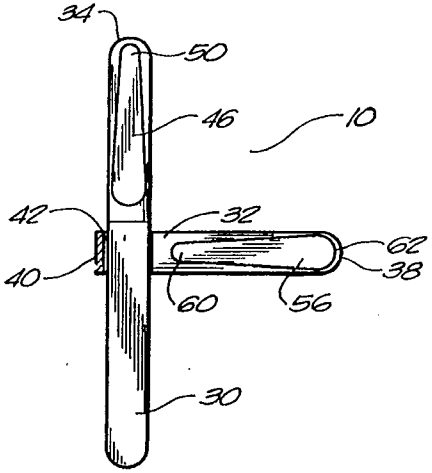
FIG. 2C is a rearward view of the preferred embodiment of the present invention.

FIGS. 2A–C show the preferred embodiment of the present invention tie clip 10 of the present invention. As can be seen in FIG. 2A, the tie clip 10 includes a first bar 30 and a second bar 32. Each of the bars 30 and 32 has a generally flat outward surface. The first bar 30 is a longitudinal vertical member having curved ends 34 and 36. The second bar 32 is slidable relative to the longitudinal axis of the first bar 30. The second bar 32 is generally shorter than that of the first bar 30. The second bar 32 has a first end 38 extending outwardly from a side of the first bar 30 and a second end 40 positioned generally adjacent an opposite side of the first bar 30. A narrow portion 42 is formed through the thickness of the second bar 32 so as to provide a guide area for the movement of the second bar 32 through the slot of the first bar 30.

The bars 30 and 32 can be plated with gold, silver, palladium, or nickel. The bars 30 and 32 could also be made entirely of solid gold, silver, or a white metal casting alloy. The bars 30 and 32 could also be made out of aluminum which will allow it to be anodized in various colors. The tie clip of the present invention could also be made from plastic. Since various materials and finishes could be used for the present invention, the scope of the present invention should not be limited by such materials.

As can be seen in FIG. 2B, the tie clip 10 has a slot 44 extending longitudinally along the first bar 30. This slot has a suitable opening so as to receive the portion 42 of the second bar 32. The slot 44 terminates at ends 45 and 47. As such, the slot 44 provides a length of travel for the second bar 32. As can be seen, the second bar 32 has a thickness generally matching the thickness of the first bar 30. The end 40 of the second bar 32 extends outwardly from the side of the first bar 30.

Importantly, in FIG. 2B, it can be seen that the first bar 30 has a first clip 46 positioned on a surface adjacent to end 34. The first clip 46 is an alligator clip which is received within an indentation formed on the top surface 48 of the first bar 30. The first clip 46 has an openable end 50 adjacent the end 34. The first clip 46 includes an actuating end 54 positioned adjacent to the second bar 32. In this configuration, the openable end 50 is suitable for affixing to the loop 20 of a tie 12. The second bar 32 has a second clip 56 affixed to a surface thereof. The clip 56 has a configuration similar to the clip 46. The clip 56 extends in a direction transverse to that of clip 46. The slotted relationship of the bars 30 and 32 provide relative travel between the clips 46 and 56.

FIG. 2C shows a rearward view of the tie clip 10 of the present invention. The clips 46 and 56 are illustrated diagrammatically. As can be seen, the first clip 46 extends so that the openable end 50 is adjacent to the end 34 of first bar 30. The second clip 56 is positioned on the second bar 32 such that the openable end 60 is positioned adjacent to the first bar 30. The actuating end 62 of the second clip 56 is positioned adjacent to the end 38 of the second bar 32. The configuration of the portion 42 serves to maintain the second bar 32 in its transverse alignment with the first bar 30. In normal use, the openable end 60 of the second clip 56 will fasten to the placket of the shirt. The openable end 50 of the first clip 46 will be attached to the loop 20 of tie 12.

Figure 3:
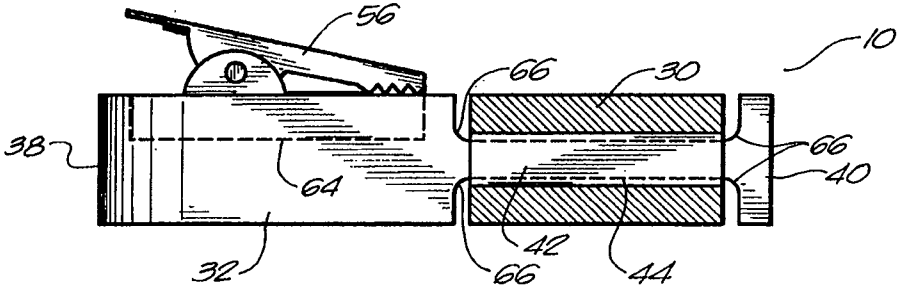
FIG. 3 is a cross-sectional top view of the preferred embodiment of the present invention.

FIG. 3 shows a cross-sectional view of the clip 10. In particular, it can be seen that the second bar 32 has a portion 42 which extends through the slot 44 of the first bar 30. End 40 extends outwardly from one side of the first bar 30. The other end 38 extends outwardly from the other side of the first bar 30. Portion 42 extends through the interior of slot 44. As can be seen, the clip 56 is received within indentation 64 formed in a surface of the second bar 32.

Importantly, in FIG. 3, it can be seen that the portion 42 has radiused surfaces 66 which serve to connect the portion 42 with the ends 38 and 40. These radiused surfaces provide for the smooth travel of the portion 42 within the slot 44 of first bar 30. Through experimentation, it has been found that these curved surfaces 66 enhance the stability of the travel, avoids the marring of the surfaces, generally prevents scratching, and enhances the appearance of the tie clip 10.

Figure 4:
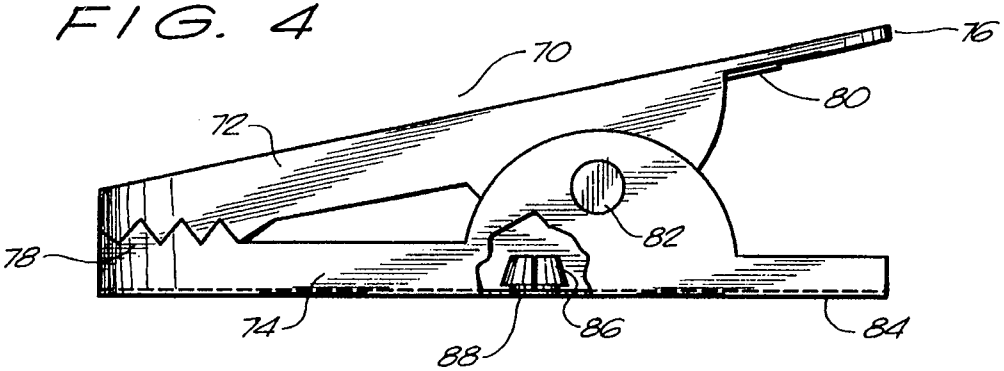
FIG. 4 is an enlarged, partially cut away, view of the clip of the present invention.

In FIG. 4, the clip 70 is illustrated. Clip 70 is similar to the previous described clips 46 and 56 of the previous figures. Clip 70 has a first face 72, a second face 74, an actuating end 76, and a toothed engagement end 78. A thin spring 80 serves to provide resistance against the opening of the toothed engagement end 78. The first face 72 is pivotted at a center of rotation 82 with respect to the second face 74. The second face 74 has a flat bottom surface 84 which is affixed within the indentations of the first bar or the second bar. When pressure is applied to the actuating end 76, so as to overcome the resistance of spring 80, the toothed engagement end 78 will open so as to expose the teeth of end 78.

The toothed engagement end 78 provides full tooth contact between the faces 72 and 74. The meshing and linear design of the teeth 78 of the clip 70 provides a stronger gripping surface that does not become dislodged, offset or pivot from awkward movements. This is a significant advantage over non-meshing curvilinear designs of the prior art. The prior art clips can easily pivot because of the relatively small surface area that grips the shirt (or the loop) and the lack of meshing teeth. The low center of rotation 82 of the clip 70 relative to the surface 84 allows for easier placement of the tie clip as compared to the prior art. This low center of rotation allows the clip 70 to be easily opened with just the thumb and forefinger applied to the actuating end 76 of clip 70. The thin spring 80 provides less resistance when opening the clip. The configuration of the clip 70 is appropriate because it does not cut, damage, or leave marks on shirts or designer labels. The clip 70 provides a strong gripping means that does not become dislodged, offset, or pivot.

The surface 84 of clip 70 can be fastened within the indentation of the bars by soldering, spot welding, tack welding, fusion welding, gluing, or any other attachment means. However, the present invention shows the use of a special fastener 86 which is shown as positioned within a hole 88 formed in the bottom surface 84 of clip 70. The fastener 86 is affixed within the indentation of the bars 30 or 32 and extends upwardly therefrom.

Figure 5:
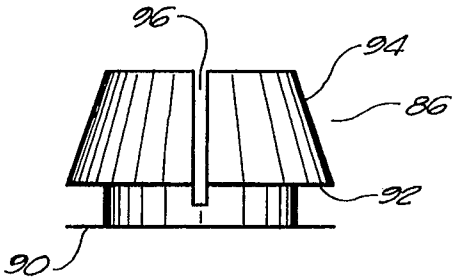
FIG. 5 is an enlarged isolated view of the fastener as used with the clip of FIG. 4.

FIG. 5 illustrates the fastener 86. Fastener 86 is affixed at the bottom 90 to the surface of the bars. The fastener 86 has a generally cylindrical configuration extending upwardly. A shouldered area 92 is provided adjacent to the surface 90. In normal use, the opening 88 of the clip 70 will be interposed between the surface 90 and the shoulder 92. This configuration serves to retain the clip in its proper position. An angled area 94 extends inwardly and upwardly from the shoulder 92. The angled area 94 serves as a guide for the proper positioning of the clip 70 on the fastener 86. A slot 96 is provided in the cylindrical configuration of the fastener 86. The slot 96 allows the outer surfaces of the fastener 86 to be compressed so as to allow the opening 88 to slide over the angled edge 94 and into the area between shoulder 92 and surface 90. Alternatively, instead of compressing the slot 96, the opening 88 can simply be placed on the outer surfaces of the fastener 86 and pushed into its proper position.

FIGS. 6A–6C show a first alternative embodiment of the present invention. In the embodiment of FIGS. 6A–6C, the tie clip 100 is shown in which the second bar 102 slides over the outer surfaces of the first bar 104. As is illustrated in FIG. 6A, the first bar 104 has a stop member 106 at one end. The second bar 102 extends outwardly transverse to the longitudinal orientation of the first bar 104. The second bar 102 includes an area which extends over the outer surfaces of the first bar 104.

FIG. 6B shows a side view of the configuration of FIG. 6A. In particular, it can be seen that the first clip 108 is affixed within an indentation 110 at one end 112 of the first bar 104. The first bar 104 has a relatively narrow thickness 114 between the clip 108 and the stop 106. This narrow thickness 114 is received within an opening formed in the second bar 102. The second clip 115 is positioned on a surface of the second bar 102 and is arranged in generally transverse relationship with respect to the first clip 108. The combination of the stop 106 and the thickness of the first bar 114 will provide a stop area having a thickness greater than that of the width of the opening in the second bar 102. The second bar 102 will have a length of travel between the stop 106 and the shoulder 116.

In FIG. 6C, it can be seen that the first clip 108 has an openable end 120 adjacent to the end 112 of the first bar 104. Similarly, the second bar 102 has the second clip 115 with an openable end 122 adjacent to the first bar 104. The actuating end 124 of the second clip 115 is adjacent to the end 126 of the second bar 102. As can be seen, the second bar extends over the outer surface of the first bar 104.

FIG. 7 shows a top cross-sectional view of the embodiment of the tie clip 100 as illustrated in FIGS. 6A–6C. As can be seen, the second bar 102 has an opening 128 which receives the narrow thickness 114 of the first bar 104. The opening 128 has a width that is greater than the thickness of the first bar 114. Importantly, the opening 128 includes radiused corners 130 adjacent to the corners of the rectangular cross-section of the first bar 114. The radiused corners 130 serve to minimize friction, prevent marring, and further facilitates the proper orientation of the first bar 104 with respect to the second bar 102. The second clip 115 is illustrated with its openable end 122 generally adjacent to the first bar 104. The second clip 115 is received within indentation 110.

FIGS. 8A–8C shows a second alternative embodiment of the tie clip 150 of the present invention. In FIG. 8A, it can be seen that there is a first bar 152 and a second bar 154. The second bar 154 includes a portion 156 which extends over the outer surface of the first bar 152. In FIG. 8B, it can be seen that the first bar 152 has a slot 158 extending longitudinally therein. The second bar 154 is received within the slot 158 so as to be slidable in relationship to the first bar 152. As can be seen, the second bar 154 has a thickness which is greater than the thickness of the first bar 152. In FIG. 8C, it can be seen that the first bar 152 has a first clip 160 positioned at one end. The second bar 154 has a second clip 162 positioned thereon. The second bar 154 is received within slot 158 so that an end 164 extends outwardly from an opposite side of the first bar 152 from that of the clip 162. As such, the bottom surface of first bar 152 is not covered by the second bar 154.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A tie clip comprising:

a first bar;

a second bar extending transversely to said first bar, said second bar slidably connected to said first bar;

a first clip affixed to a surface of said first bar; and a second clip affixed to a surface of said second bar.

2. The tie clip of claim 1, said second bar being no longer than said first bar.

3. The tie clip of claim 2, said second bar slidable along a longitudinal axis of said first bar.

4. The tie clip of claim 1, said first bar having a longitudinal slot formed therewithin, said second bar having a portion received within said longitudinal slot, said portion slidable within said slot.

5. The tie clip of claim 4, said second bar having one end extending outwardly from one side of said first bar, said second bar having another end extending outwardly on an opposite side of said first bar, said portion positioned between the ends of said second bar.

6. The tie clip of claim 5, said second bar having a thickness generally equal to a thickness of said first bar, said portion having a thickness less than a width of said slot.

7. The tie clip of claim 1, said second bar having an interior opening formed therein, said first bar extending through said opening, said second bar slidable along an outer surface of said first bar.

8. The tie clip of claim 7, said first bar having a stop positioned on an end of said first bar opposite said first clip, said first bar and said stop having a thickness greater than a width of said opening.

9. The tie clip of claim 1, said first clip having an openable end positioned adjacent an end of said first bar, said second clip having an openable end facing said first bar.

10. The tie clip of claim 1, each said first bar and said second bar having a top surface, said first clip affixed to said top surface of said first bar, said second clip affixed to said top surface of said second bar.

11. The tie clip of claim 1, each of said first clip and said second clip being an alligator clip, said alligator clip having an openable end and an actuating end, said openable end of said first clip positioned adjacent an end of said first bar, said actuating end of said second clip positioned adjacent an end of said second bar opposite said first bar.

12. The tie clip of claim 1, said first bar having an indented surface formed adjacent one end of said first bar, said first clip received within said indented surface, said second bar having an indented surface adjacent an end opposite said first bar, said second clip received within said indented surface.

13. The tie clip of claim 5, said portion having radiused corners joining said portion to the ends of said second bar, said portion having flat surfaces extending between said radiused corners.

14. The tie clip of claim 1, said first bar having a fastener affixed thereto, said first clip having an opening formed therein, said fastener received within said opening so as to secure said clip to said first bar.

15. The tie clip of claim 14, said fastener being a member having one end affixed to said first bar, said member having a shouldered area formed along an outer diameter of said member, said first clip positioned between said shouldered area and said first bar.

16. The tie clip of claim 15, said member having a generally conical configuration, said member having a slot extending through said conical configuration.

17. The tie clip of claim 1, said first clip having a toothed engagement area, said toothed engagement area for affixing to a designer label of a tie, said second clip having a toothed engagement area for affixing to a placket of a shirt.

18. The tie clip of claim 7, said first bar having a rectangular cross-section, said interior opening having radiused corners adjacent edges of said rectangular cross-section.

19. The tie clip of claim 5, said second bar having an outer surface extending over a top surface of said first bar, said second bar having a thickness greater than said first bar.

* * * * *